US010903596B2

(12) United States Patent
Ilie

(10) Patent No.: US 10,903,596 B2
(45) Date of Patent: Jan. 26, 2021

(54) ELECTRICAL CONNECTOR HAVING A PLURALITY OF RESTRAINTS

(71) Applicant: Razvan Ilie, Rocquencourt (FR)

(72) Inventor: Razvan Ilie, Rocquencourt (FR)

( * ) Notice: Subject to any disclaimer, the term of this patent is extended or adjusted under 35 U.S.C. 154(b) by 0 days.

(21) Appl. No.: 16/664,547

(22) Filed: Oct. 25, 2019

(65) Prior Publication Data

US 2020/0136288 A1 Apr. 30, 2020

(30) Foreign Application Priority Data

Oct. 25, 2018 (FR) ..... 18 59867

(51) Int. Cl.

| | |
|---|---|
| ***H01R 4/48*** | (2006.01) |
| ***H01R 13/11*** | (2006.01) |
| ***H01R 4/18*** | (2006.01) |
| ***H01R 13/03*** | (2006.01) |
| ***H01R 13/18*** | (2006.01) |

(52) U.S. Cl.

CPC ..... *H01R 13/111* (2013.01); *H01R 4/183* (2013.01); *H01R 13/03* (2013.01); *H01R 13/18* (2013.01)

(58) Field of Classification Search

CPC ..... H01H 85/202; H01H 13/03; H01H 13/18; H01H 13/113; H01R 13/112; H01R 23/7068

USPC ..... 439/833, 886, 839, 856–857, 924.1

See application file for complete search history.

(56) References Cited

U.S. PATENT DOCUMENTS

| | | | | |
|---|---|---|---|---|
| 1,936,469 | A * | 11/1933 | Hill | H01H 1/38 439/886 |
| 2,346,831 | A * | 4/1944 | Drury | H01R 13/18 439/839 |
| 4,772,233 | A * | 9/1988 | Hoffman | H01R 13/18 439/833 |
| 6,976,862 | B1 | 12/2005 | Ormazabal Ocerin | |
| 2013/0323591 | A1* | 12/2013 | Woehrle | H01M 2/202 429/211 |

FOREIGN PATENT DOCUMENTS

| | | | |
|---|---|---|---|
| EP | 3208892 | A1 | 8/2017 |

OTHER PUBLICATIONS

French Search Report for Application No. FR1859867, dated Jul. 5, 2019 in 2 pages.
Written Opinion for for Application No. FR1859867 in 6 pages.

* cited by examiner

*Primary Examiner* — Phuong Chi Thi Nguyen
(74) *Attorney, Agent, or Firm* — Knobbe, Martens, Olson & Bear, LLP

(57) ABSTRACT

An electrical connector has a male contact and a female contact, which are movable between a non-inserted position and an inserted position. An insertable part of the male contact is inserted along an insertion axis into a housing of the female contact. The female contact includes a body and a plurality of strips protruding axially from the body and distributed angularly. The strips are radially flexible. The connector can also include a number of annular restraints that are structurally identical to one another, arranged on the strips, and suitable for exerting a centripetal radial pressure on the strips. At least two restraints respectively have distinct angular orientations from one another relative to the body around the insertion axis.

13 Claims, 6 Drawing Sheets

ELECTRICAL CONNECTOR HAVING A PLURALITY OF RESTRAINTS

CROSS-REFERENCE TO RELATED APPLICATION

Figure 1:
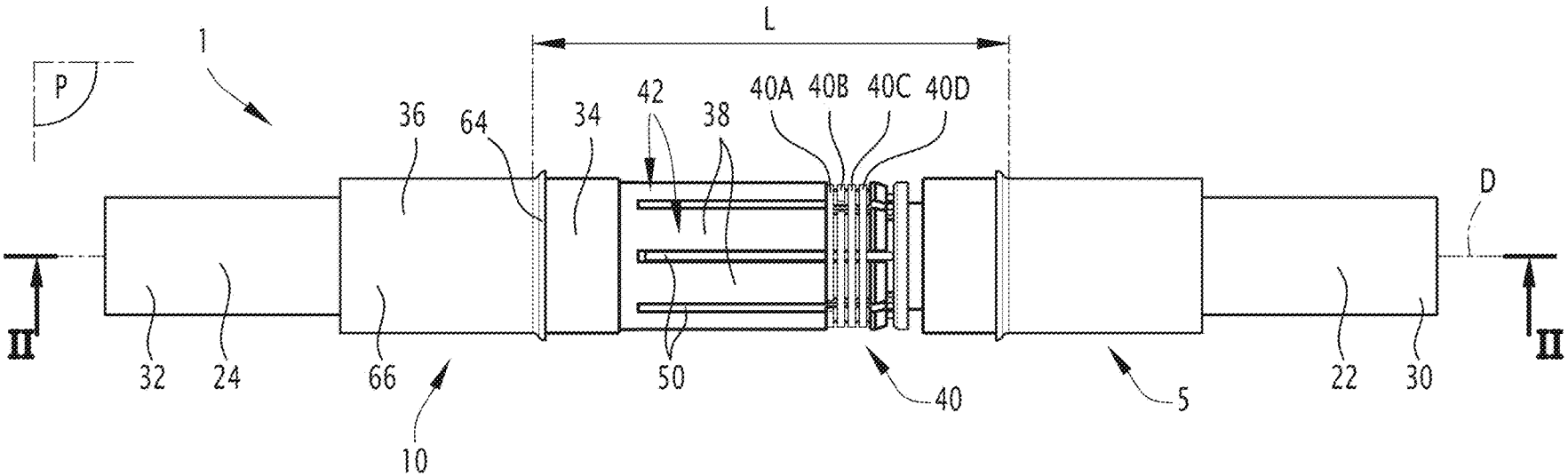

This application claims priority to French Patent Application No. 18 59867 filed on Oct. 25, 2018, the disclosure of which including the specification, the drawings, and the claims is hereby incorporated by reference in its entirety.

BACKGROUND OF THE INVENTION

Field of the Invention

The present invention relates to an electrical connector having a male contact and a female contact that are movable between a non-inserted position, in which the male contact is separated from the female contact, and an inserted position, in which an electrically conductive insertable part of the male contact is inserted along an insertion axis into a housing defined by the female contact.

The electrical connector is for example a power connector, that is to say, it is suitable for transmitting a current with an intensity greater than or equal to 10 A.

Description of Related Art

Two categories of these electrical connectors are currently known. A first category encompasses connectors having an interface suitable for guaranteeing a good contact surface. The interface is typically made using wires or a stamped plate in order to create the appropriate shape. This category has the advantage of having low insertion forces and good resistance to vibrations. However, the number of parts used to produce the interface is relatively high, and the space occupied by the interface creates bulk. Furthermore, this type of connector has a relatively high cost.

In the second category, the electrical contact is ensured by the pressure of the two contacts, which must be high, in order to compensate for a small contact surface. These connectors have a lower manufacturing cost, but also high insertion forces and an inferior resistance to vibrations and fretting, that is to say, wear caused by contact that affects the surfaces of the male contact and the female contact that are in contact.

In order to improve the quality of this type of electrical connector, it has been proposed for the female contact to include flexible strips surrounding the insertable part of the male contact; an annular contention member, formed by a blade curved in a "C" shape, is sometimes used to increase the pressure of the strips on the insertable part.

However, it has been observed that these connectors, although satisfactory because they offer a reasonable insertion force, nevertheless have a relatively high electrical resistance. Indeed, in particular when the connector is used to electrically connect cable portions made from aluminum or an aluminum alloy, the resistance of the connector remains substantially higher than that of a cable portion of equivalent length.

One aim of the invention is therefore to provide an electrical connector still having a reasonable insertion force, but also a lower electrical resistance, while remaining easy to manufacture and having a competitive price.

BRIEF SUMMARY OF THE INVENTION

To that end, the invention relates to an electrical connector having a male contact and a female contact that are movable between a non-inserted position, in which the male contact is separated from the female contact, and an inserted position, in which an electrically conductive insertable part of the male contact is inserted along an insertion axis into a housing defined by the female contact, the female contact including:

an electrically conductive body, and a plurality of strips protruding axially from the body and distributed angularly around the insertable part in the inserted position, the strips being electrically conductive and radially flexible, the body and the strips defining said housing, the electrical connector further comprising a plurality of annular restraints that are structurally identical to one another and arranged on radially outer faces of the strips, each of the restraints being suitable for exerting a centripetal radial pressure on the strips in the inserted position, the strips having radially inner faces pressed against the insertable part in the inserted position, at least two of the restraints respectively having angular orientations distinct from one another relative to the body around the insertion axis.

According to specific embodiments, the electrical connector includes one or more of the following features, considered alone or according to any technically possible combination(s):

- said plurality comprises N restraints, N being a natural integer greater than or equal to two, each of the restraints having an angular orientation relative to the body around the insertion axis, said angular orientations being offset successively relative to one another by an angle substantially equal to 360° divided by N;
- each of the restraints comprises a blade curved in a "C" shape;
- the radially outer face of each of the strips defines one or several circumferential slot(s) receiving the restraints;
- the male contact comprises a body on which the insertable part is fastened, the bodies of the male contact and the female contact, as well as the insertable part and the strips, being made from aluminum or aluminum alloy;
- at least one of the female contact and the male contact further comprises a ring made from aluminum or aluminum alloy defining an axially through housing, the ring being suitable for axially receiving an electrical cable portion, the body of said at least one of the female contact and the male contact being suitable for being friction welded to a base of the ring and to a conductive part of the electrical cable portion;
- the ring comprises an enclosure extending axially from the base and configured to surround the electrical cable portion, the enclosure including a crimping collar axially opposite the base and extending around the insertion axis, the crimping collar being suitable for being crimped tightly on an insulating sheath of the electrical cable portion;
- the crimping collar defines an inner slot, the electrical connector further comprising at least one O-ring extending in the slot around the insertion axis, the O-ring being configured to be situated radially between the ring and the insulating sheath of the electrical cable portion;
- the crimping collar includes, in cross-section along a radial half-plane, a radially protruding part configured to bite into the insulating sheath;
- the female contact includes four strips and two restraints; the female contact includes six strips and three restraints; the female contact includes eight strips and four restraints; the female contact includes ten strips and six restraints, or the female contact includes twelve strips and eight restraints; and the body of the female contact defines a groove extending around the insertion axis and emerging in the housing.

BRIEF DESCRIPTION OF THE SEVERAL VIEWS OF THE DRAWING(S)

Figure 2:
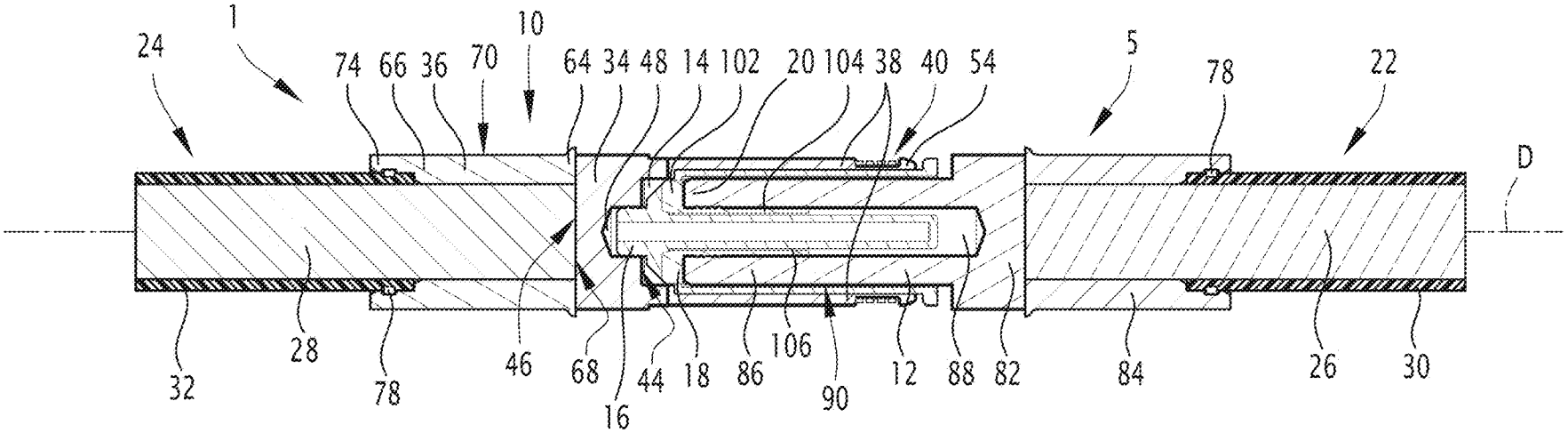
Figure 3:
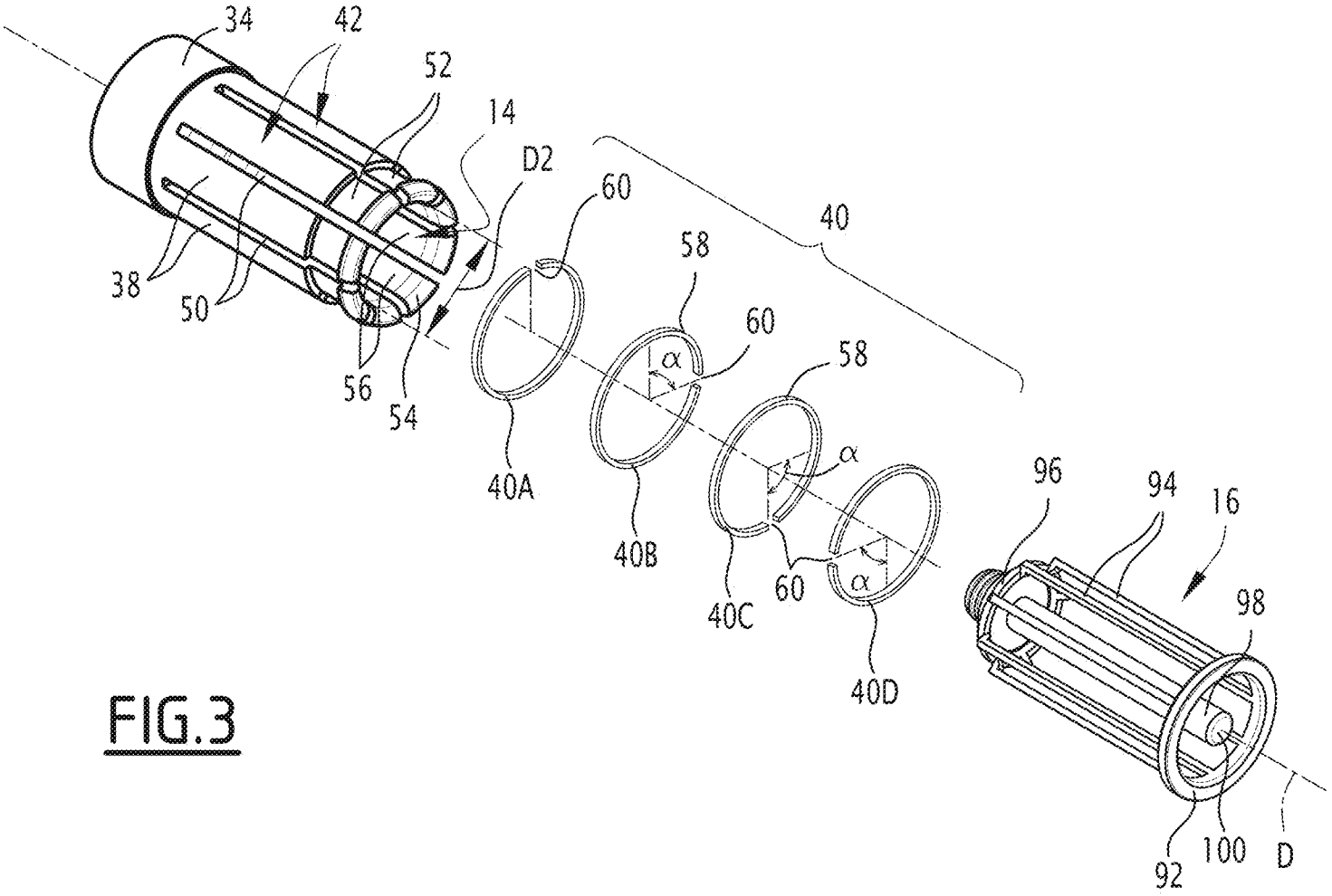
Figure 4:
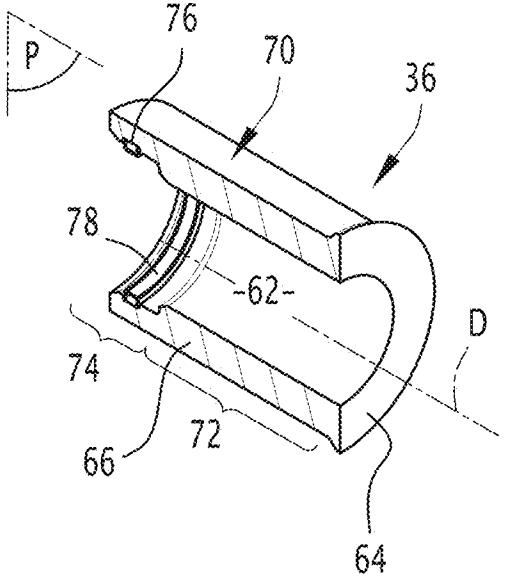
Figure 5:
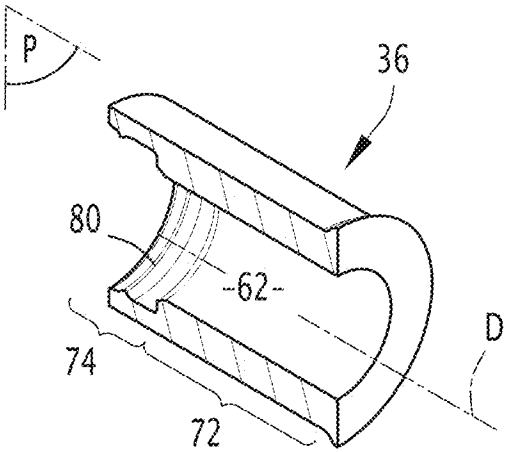
Figure 6:
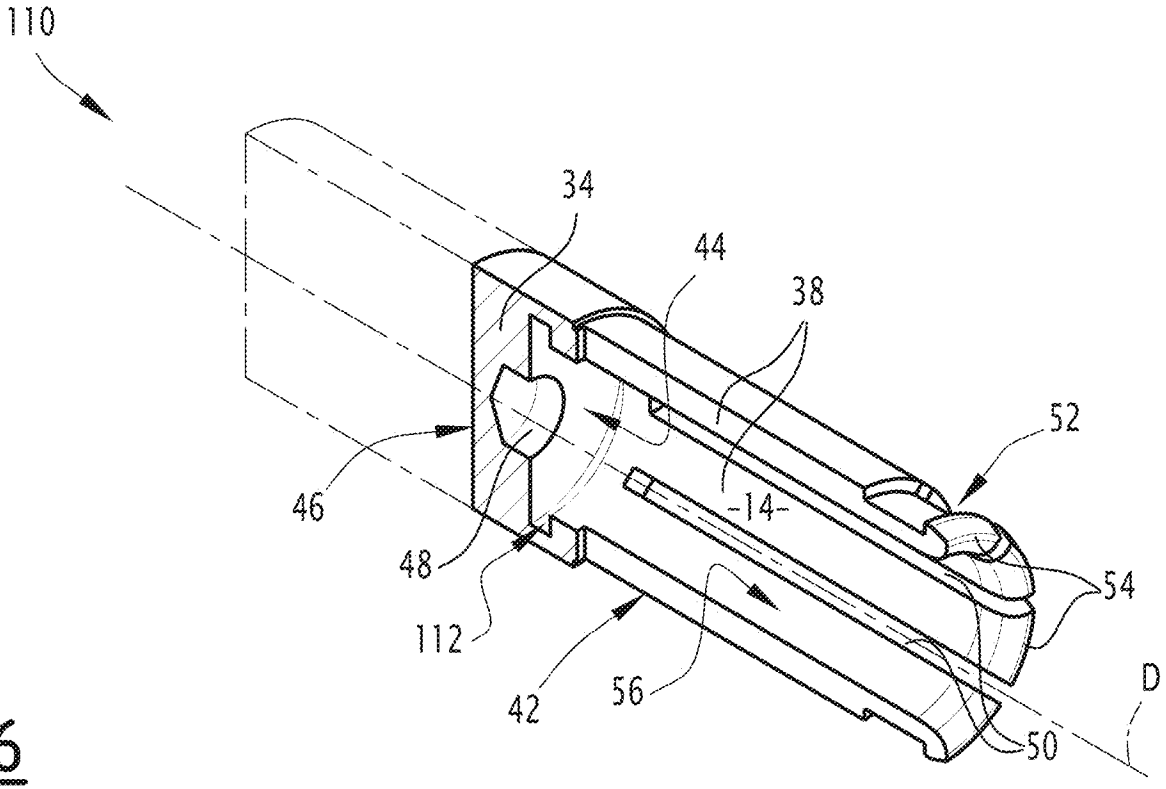

The invention will be better understood upon reading the following description, provided solely as an example, and done in reference to the appended drawings, in which:

FIG. 1 is a side view of an electrical connector according to the invention in the inserted position, FIG. 2 is a radial cross-sectional view of the connector shown in FIG. 1, FIG. 3 is a partial, exploded perspective view of the female contact of the connector shown in FIGS. 1 and 2, FIG. 4 is a radial, cross-sectional perspective view of a ring present in the male contact and in the female contact of the electrical connector shown in FIGS. 1 and 2, FIG. 5 is a radial and perspective cross-sectional view of a ring making up a variant of the ring shown in FIG. 4, and FIG. 6 is a partial, cross-sectional and perspective view of a female contact making up a variant of the female contact shown in FIGS. 1 to 3.

DETAILED DESCRIPTION OF THE INVENTION

An electrical connector 1 according to the invention is described in reference to FIGS. 1 and 2.

The electrical connector 1 comprises a male contact 5 and a female contact 10 that are movable between an inserted position (FIGS. 1 and 2), in which an electrically conductive insertable part 12 (FIG. 2) of the male contact is inserted along an insertion axis D into a housing 14 (FIG. 3) defined by the female contact, and a non-inserted position (not shown), in which the male contact is separated from the female contact.

The non-inserted position is deduced from the inserted position shown in FIGS. 1 and 2 by an axial translation of the male contact 5 relative to the female contact 10.

The electrical connector 1 advantageously comprises a first electrical insulator 16 suitable for being inserted into the housing 14 in order to protect a user (not shown) of the electrical connector. Likewise, advantageously, the electrical connector 1 comprises a second electrical insulator 18 suitable for covering a distal end 20 of the insertable part 12 of the male contact 5.

"Distal" refers, for each of the contacts, to the side defined by the insertion direction along the insertion axis D. Correlatively, "proximal" refers to the side opposite the insertion along the insertion axis D.

The electrical connector 1 further advantageously comprises insulating sheaths (not shown) respectively surrounding the male contact 5 and the female contact 10 around the insertion axis D in order to protect these contacts from any lateral electrical contact, in particular with an operator (not shown). The insulating sheaths are of course suitable for not opposing the insertion of the male contact 5 into the female contact 10 and for ensuring protection both in the non-inserted position and the inserted position.

The male contact 5 and the female contact 10 are suitable for being in electrical contact with at least two electrical cable portions 22, 24, each respectively including a conductive portion 26, 28, and an insulating sheath 30, 32 surrounding the conductive part, except, in the example, over a distal portion of the conductive part.

Within the meaning of the present application, "conductive" refers to a material whose electrical resistance at 300 K is for example less than or equal to $10^{-5}$ Ω·m. On the contrary, "insulating" refers to a material whose electrical resistivity at 300 K is for example greater than or equal to $10^{5}$ Ω·m.

The conductive part 30, 32 is for example made from aluminum or aluminum alloy.

"Aluminum alloy" here for example refers to an alloy whose main component is aluminum, at a predominant percentage by mass in the composition of the alloy.

The considered aluminum alloys are for example AL6060.

The female contact 10 comprises a body 34, a ring 36 fastened on the body and receiving the electrical cable portion 24, a plurality of strips 38 protruding axially from the body, and a plurality 40 of annular restraints 40A, 40B, 40C, 40D that are structurally similar to one another and arranged on radially outer faces 42 of the strips 38.

The body 34, the ring 36 and the strips 38 are conductive. There are for example respectively made from aluminum or aluminum alloy.

The body 34 defines a bottom 44 of the housing 14, for example of cylindrical shape and in which the first insulator 16 is inserted. The body 34 includes a planar face 46 on which the conductive part 28 and the ring 36 are friction welded. In other words, there is a planar weld between the body 34, on the one hand, and the ring 36 and the conductive part 28, on the other hand, obtained by friction, by rotating the body on the ring and the conductive part at a high speed.

In the example, the face 46 is perpendicular to the insertion axis D. Thus, the friction welding is done by rotating the body relative to the ring 36 and the conductive part 28 around the insertion axis D.

The bottom 44 advantageously defines a cavity 48 for fastening the first insulator 16 on the body 34.

The strips 38 are distributed angularly around the insertable part 12 in the inserted position. There are at least two strips 38. In the illustrated example, there are eight strips 38.

According to variants that are not shown, there are four, six, eight, ten or twelve strips 38.

The strips 38 radially delimit the housing 14.

The strips 38 are advantageously identical to one another and distributed regularly around the insertion axis D. Two angularly consecutive strips 38 are advantageously separated by a slit 50.

Each of the strips 38 respectively defines a circumferential slot 52, and these circumferential slots are aligned one after the other around the insertion axis D and suitable for receiving all of the restraints 40A to 40D.

According to a variant that is not shown, each strip 38 defines several circumferential slots that are parallel to one another, each of the slots receiving one or several of the restraints 40A to 40D.

The strips 38 are radially flexible, that is to say, their distal ends 54 are capable of coming radially closer to or further from the insertion axis D.

In the non-inserted position, the strips 38 are for example slightly curved toward the insertion axis D as one approaches their distal ends 54.

The strips 38 and the restraints 40A to 40D being flexible, the distal ends 54 define a distal opening of the housing 14 having a smaller diameter D2 in the non-inserted position than in the inserted position.

In the non-inserted position, the slits 50 for example have a length, along the insertion axis D, of between 5 mm and 80 mm, and a width, in the circumferential direction, of between 0.2 mm and 2.5 mm.

In the inserted position, the strips 38 have radially inner faces 56 pressed against the insertable part 12.

The restraints 40A to 40D are suitable for exerting a centripetal radial pressure on the strips 38 in the inserted position.

In the illustrated example, there is only a single plurality 40 of restraints that are structurally similar to one another.

According to variants that are not shown, there are several pluralities, or series, of restraints that are similar to one another within a same series, but not from one series to another.

Still in the illustrated example, there are four restraints 40A to 40D.

According to variants that are not shown, the number of restraints is two (in particular if there are four strips), three (in particular if there are six strips), six (if there are ten strips), or eight (if there are twelve strips).

Advantageously, the number of restraints is greater than or equal to the number of strips 38 divided by two.

Each of the restraints for example comprises a blade 58 (FIG. 3) curved around the insertion axis D and assuming the shape of a "C". Each of the restraints 40A to 40D advantageously forms an annulus having an interruption 60.

Each of the restraints 40A to 40D is advantageously made up of a material having a thermal expansion coefficient lower than that of the strips 38 of the female contact 10, and lower than that of the insertable part 12 of the male contact 5.

For example, the restraints 40A to 40D are made from stainless steel, with a thermal expansion coefficient of $14.10^{-6}$ $K^{-1}$. The strips 38 and the insertable part 12, if they are made from aluminum, have a thermal expansion coefficient of $23.10^{-6}$ $K^{-1}$.

The interruption 60 for example measures between 0.1 mm and 3 mm in the circumferential direction. The interruption 60 is capable of giving each of the restraints 40A to 40D a resiliency suitable for keeping the strips 38 pressed on the insertable part 12.

As shown in FIG. 3, the restraints 40A to 40D respectively show angular orientations relative to the body that are distinct from one another. In the illustrated example, the angular orientations are defined by the interruptions 60 and are distinct because the interruptions are not axially aligned.

In a variant, the restraints 40A to 40D have shapes other than a blade curved in a "C", but asymmetrical around the insertion axis D, so as always to define an angular orientation around this axis.

In the illustrated example, the restraints 40A to 40D are offset, successively along the insertion axis, by an angle $\alpha$ equal to 90° relative to the previous one.

According to variants that are not shown, the angular offsets are not successive (that is to say, the restraints are placed in a different order along the insertion axis D), or are not identical (that is to say, they have values different from 90°).

Advantageously, each angular offset is substantially equal to 360° divided by N, N being the number of restraints in the plurality.

The thickness of the blades 58 is for example between 0.5 mm and 3 mm in the radial direction.

The ring 36 defines an axially through housing 62 that receives the electrical cable portion 24. The ring comprises a base 64, and an enclosure 66 extending axially from the base and configured to surround the electrical cable portion 28.

The base 64 and the conductive portion 28 of the electrical cable portion 24 form a face 68 friction welded to the body 34. In the illustrated example, this face 68 is perpendicular to the insertion axis D.

The enclosure 66 is suitable for being tightly crimped on the electrical cable portion 28. As shown in FIGS. 2 and 4, the enclosure 66 for example has a cylindrical outer surface 70 around the insertion axis D. The enclosure 66 for example includes a main part 72, located axially near the base 64 and in contact with the conductive part 28 of the electrical cable portion 24, and a crimping collar 74 in contact with the insulating sheath 32 of the electrical cable portion 24.

The main part 72 is advantageously radially thicker than the crimping collar 74.

The crimping collar 74 advantageously defines an inner slot 76 extending around the insertion axis D and in which an O-ring 78 is located for ensuring the sealing between the ring 36 and the insulating sheath 32.

According to a variant shown in FIG. 5, the crimping collar 74 includes, in cross-section along a radial half-plane P, a radially protruding part 80 configured to bite into the insulating sheath 32.

Aside from the insertable part 12, the male contact 5 includes an electrically conductive body 82, and a ring 84 provided to receive the electrical cable portion 22.

The insertable part 12 protrudes axially from the body 84.

The insertable part 12 comprises a contact portion 86 suitable for being in contact with the strips 38 in the inserted position, and the distal end 20 already mentioned above.

Advantageously, the insertable part 12 also defines an axial housing 88 emerging on the distal end 20 and suitable for receiving the second insulator 18 (FIG. 2).

The contact portion 86 includes a cylindrical radially outer surface 90.

In a variant (not shown), the radially outer surface 90 is frustoconical.

In the example, the ring 84 of the male contact 5 is similar to the ring 36 of the female contact 10 and will not be described in detail.

According to a variant that is not shown, the ring 36, 84 of one or the other of the male contact 5 and the female contact 10 is replaced by a lug fastened on the body of the contact in question, for example using a screw.

As shown in FIG. 2, the first insulator 16 comprises an annulus 92 suitable for capping the distal ends 54 of the strips 38, and fasteners 94 extending axially from the annulus and provided to be inserted into the slits 50 between the strips in order to fasten the first insulator on the female contact 10. The first insulator 16 further comprises a base 96 situated axially opposite the annulus 92, and a finger 98 extending axially from the base toward the annulus.

The fasteners 94 advantageously form bars fastened on the base 68 and oriented substantially axially. The first insulator 16 thus has the appearance of a cylindrical cage.

The finger 98 is situated substantially at the center of the housing 14 seen along the insertion axis D when the first insulator 16 is inserted into the housing. The finger 98 includes a distal end 100 substantially situated at the center of the annulus 92. The finger 98 is for example substantially cylindrical.

The second insulator 18 (FIG. 2) includes a head 102 and a rod 104 that is suitable for being introduced into the axial housing 88 of the male contact 5. The second insulator 18 defines a housing 106 extending axially and emerging on the head 102.

The housing 106 is suitable for receiving the finger 98 of the first insulator 16 in the inserted position of the electrical connector 1.

The operation of the connector 1 is deduced from its structure and will be briefly described hereinafter.

When the electrical connector 1 is running, the electrical cable portions 22, 24 are received in the housings 62 of the rings 36, 84.

To that end, the electrical cable portions 22, 24 are introduced into the housings 62 defined by the rings. The body 34 of the female contact 10 is friction welded to the face 68 formed by the conductive portion 28 of the electrical cable portion 24 and by the base 64 of the ring 36. Likewise, the body 82 of the male contact 5 is friction welded to the face formed by the conductive portion 26 of the electrical cable portion 22 and by the base of the ring 84.

The first insulator 16 and the second insulator 18 are advantageously respectively inserted into the female contact 10 and the male contact 5 along the insertion axis D.

To that end, the fasteners 94 are inserted into the slits 50 until the annulus 92 conceals the distal ends 54 of the strips 38. The base 96 is then fastened on the body 34 by jamming, or in a variant by snapping.

In order to install the second electrical insulator 18, the rod 104 is introduced into the housing 88 of the insertable part 12 along the insertion axis D, until the head 102 covers the distal end 20.

The electrical connector 1 is then ready to use.

It will be recalled that the outer sheaths (not shown) protect the operator against any untimely contact in the radial direction with the male contact 5 or the female contact 10.

The first electrical insulator 16 protects distal ends 54 of the female contact 10. The annulus 92 and the finger 98 cooperate to prevent the operator from inserting his finger into the housing 14. However, owing to its cage-forming structure, the first electrical insulator 16 does not prevent electrical contact between the strips 38 and the radially outer surface 90 of the contact portion 86 of the insertable part 12.

Likewise, the second electrical insulator 18 prevents the operator from touching the distal end 20 of the insertable part 12.

The electrical contact 1 is then placed in the inserted position shown in FIGS. 1 and 2.

The male contact 5 is inserted into the housing 14 along the insertion axis D. The contact portion 86 penetrates the housing 14, which causes a radial separation of the distal ends 54 of the strips 38. This radial separation is limited by the action of the restraints 40A to 40D.

During the insertion, the finger 98 of the first electrical insulator 16 penetrates inside the housing 106 of the second electrical insulator 18, such that the electrical insulators 16, 18 do not hinder the insertion.

During the insertion, each of the restraints 40A to 40D expands, while applying a centripetal pressure on the strips 38. This pressure contributes to pressing the radially inner faces 56 of the strips 38 on the contact portion 86 of the insertable part 12.

Since the restraints 40A to 40D do not have a symmetry of revolution around the insertion axis D, their individual actions on the insertable part 12 are not angularly uniform.

However, owing to the presence of several restraints and their angular offset, the overall action of the restraints 40A to 40D is more angularly homogeneous than if it for example had only one restraint.

In the illustrated inserted position, the strips 38 are therefore better pressed on the contact portion 86, the radially outer surface 90 of which they marry. The resistance of the electrical connector 1 is therefore decreased.

Owing to the friction-welded rings 36, 84, the electrical resistance of the electrical connector 1, measured over a length L between the bases of the rings, is practically equal to that of the conductive part of electrical cable portions over this same length.

In case of heating of the electrical connector 1, for example by Joule effect, the restraints 40A to 40D expand less and exert a stronger centripetal radial pressure on the strips 38 than in the non-heated state. This results in an increase in the pressure exerted by strips 38 on the insertable part 12, and an increase in the contact surface between the strips and the insertable part. This reduces the contact resistance and causes a decrease in the heating of the electrical connector 1 during use.

In the inserted position, the electrical connector 1 has a high level of mechanical stability owing to the structure of the strips 38 and the action of the restraints 40A to 40D. Furthermore, the insertion of the male contact 5 into the female contact 10 remains very easy due to the flexibility of the strips 38 and the resiliency of the restraints 40A to 40D.

The electrical connector 1 is therefore extremely high-performing, as regards both the ease of insertion and the resistance to vibrations.

The electrical connector 1 has a small bulk compared to its electrical performance.

Due to its relatively simple structure, with no interface, the electrical connector 1 therefore remains easy to manufacture and has a competitive price.

Owing to the electrical insulators 16, 18, the operator is protected during the handling of the electrical connector 1.

In reference to FIG. 6, a female contact 110 is described constituting a variant of the female contact 10. The female contact 110 is similar to the female contact 10 shown in FIGS. 1 to 3. Like elements bear like numerical references and will not described again. Only the differences will be described below.

The body 34 of the female contact 110 defines a groove 112 extending around the insertion axis D and emerging in the housing 14. Axially, the groove 112 extends between the bottom 44 of the housing 14 and the strips 38.

In the illustrated example, the groove 112 is axially delimited, on the side of the ring 36 (not shown in FIG. 6), by the bottom 44 of the housing 14.

The groove 112 is suitable for weakening, by thinning, the body 34 at the base of the strips 38. This makes it possible to reduce the insertion force of the male contact 5 by reducing the bending moment by 10% without damaging the electrical operation of the connector 1.

COMPARATIVE EXAMPLE

In this example, the female contact 10 comprises eight strips 38, and there are four restraints 40A to 40D, as shown in FIG. 3. For the purposes of the experiment, the eight strips are successively numbered 38.1, 38.2 to 38.8. The strips 38.1 and 38.8 and situated angularly on either side of one of the slits 52.

The dimensions of the strips are, for example: length: 33 mm; width 5.70 mm, height: 3.5 mm.

A first arrangement was first tested, not shown and not according to the invention, in which the four restraints do not have any angular offset relative to one another. The interruptions 60 of each C-shaped blade are axially aligned with the slit 52 located between the strips 38.1 and 38.2. This first arrangement is deduced from FIG. 3 by rotating the restraints 4A to 40D around the insertion axis D.

In this first arrangement, a total contact surface is obtained of 70 $mm^2$ between the eight strips and the insertable part 12 of the male contact 5. This contact surface is distributed non-homogeneously over the eight strips as follows:

strip 38.1: 17%,
strip 38.2: 15%,
strip 38.3: 10%,
strip 38.4: 8%,
strip 38.5: 8%,
strip 38.6: 10%,
strip 38.7: 15%,
strip 38.8: 17%.

Then a second arrangement was tested, shown in FIG. 3 and according to the invention, in which the four restraints have angular offsets of 90° relative to one another. Only the interruption 60 of the restraint 40A is axially aligned with the slit 52 situated between the strips 38.1 and 38.2.

In this second arrangement, a total contact surface is obtained of 100 $mm^2$ between the eight strips and the insertable part 12 of the male contact 5. This contact surface is much better in the first arrangement not according to the invention. Furthermore, the contact surface is distributed much more homogeneously over the eight strips as follows:

strip 38.1: 12.5%,
strip 38.2: 13.0%,
strip 38.3: 12.5%,
strip 38.4: 12.0%,
strip 38.5: 12.0%,
strip 38.6: 12.5%,
strip 38.7: 13.0%,
strip 38.8: 12.5%.

The homogeneous distribution makes it possible to have a homogenous behavior during the operation of the strips (same contact pressure for each strip with the male contact). This improves the electrical performance, the lifetime of the connector and the resistance to vibrations (elimination of the risk of loss of contact).

As one can see, the angular offsets at 360°/N, N being the number of restraints, made if possible to increase the contact surface and made its distribution on the strips more homogeneous.

Other tests showed that benefits appear once an angular offset exists between two of the restraints.

What is claimed is:

1. An electrical connector having a male contact and a female contact that are movable between a non-inserted position, in which the male contact is separated from the female contact, and an inserted position, in which an electrically conductive insertable part of the male contact is inserted along an insertion axis into a housing defined by the female contact, the female contact including:

an electrically conductive body, a plurality of strips protruding axially from the body and distributed angularly around the insertable part in the inserted position, the strips being electrically conductive and radially flexible, the body and the strips defining said housing, and a plurality of annular contention members that are structurally identical to one another and arranged on radially outer faces of the strips, each of the contention members being suitable for exerting a centripetal radial pressure on the strips in the inserted position, the strips having radially inner faces pressed against the insertable part in the inserted position, at least two of the contention members respectively having angular orientations distinct from one another relative to the body around the insertion axis, wherein the male contact comprises a body on which the insertable part is fastened, the bodies of the male contact and the female contact, as well as the insertable part and the strips, being made from aluminum or aluminum alloy, wherein at least one of the female contact and the male contact further comprises a ring made from aluminum or aluminum alloy defining an axially through housing, the ring being suitable for axially receiving an electrical cable portion, the body of said at least one of the female contact and the male contact being suitable for being friction welded to a base of the ring and to a conductive part of the electrical cable portion, wherein the ring comprises an enclosure extending axially from the base and configured to surround the electrical cable portion, the enclosure including a crimping collar axially opposite the base and extending around the insertion axis, the crimping collar being suitable for being crimped tightly on an insulating sheath of the electrical cable portion.

2. The electrical connector according to claim 1, wherein said plurality comprises N contention members, N being a natural integer greater than or equal to two, each of the contention members having an angular orientation relative to the body around the insertion axis, said angular orientations being offset successively relative to one another by an angle substantially equal to 360° divided by N.

3. The electrical connector according to claim 1, wherein the crimping collar defines an inner slot, the electrical connector further comprising at least one O-ring extending in the slot around the insertion axis, the O-ring being configured to be situated radially between the ring and the insulating sheath of the electrical cable portion.

4. The electrical connector according to claim 1, wherein the crimping collar includes, in cross-section along a radial half-plane, a radially protruding part configured to bite into the insulating sheath.

5. The electrical connector according to claim 1, wherein:

the female contact includes four strips and two contention members, the female contact includes six strips and three contention members, the female contact includes eight strips and four contention members, the female contact includes ten strips and six contention members, or the female contact includes twelve strips and eight contention members.

6. The electrical connector according to claim 1, wherein the body of the female contact defines a groove extending around the insertion axis and emerging in the housing.

7. The electrical connector according to claim 1, wherein each of the contention members comprises a blade curved in a "C" shape.

8. The electrical connector according to claim 7, wherein the radially outer face of each of the strips defines one or several circumferential slot(s) receiving the contention members.

9. An electrical connector having a male contact and a female contact that are movable between a non-inserted position, in which the male contact is separated from the female contact, and an inserted position, in which an electrically conductive insertable part of the male contact is inserted along an insertion axis into a housing defined by the female contact, the female contact including:

an electrically conductive body, and a plurality of strips protruding axially from the body and distributed angularly around the insertable part in the inserted position, the strips being electrically conductive and radially flexible, the body and the strips defining said housing, the connector further comprising a plurality of annular contention members that are structurally identical to one another and arranged on radially outer faces of the strips, each of the contention members being suitable for exerting a centripetal radial pressure on the strips in the inserted position, the strips having radially inner faces pressed against the insertable part in the inserted position, at least two of the contention members respectively having angular orientations distinct from one another relative to the body around the insertion axis, wherein said plurality of annular contention members comprises N contention members, N being a natural integer greater than or equal to two, each of the contention members having an angular orientation relative to the body around the insertion axis, said angular orientations being offset successively relative to one another by an angle substantially equal to 360° divided by N, wherein the contention members have asymmetrical shapes around the insertion axis, so as to define said angular orientations.

10. The electrical connector according to claim 9, wherein:

the female contact includes four strips and two contention members, the female contact includes six strips and three contention members, the female contact includes eight strips and four contention members, the female contact includes ten strips and six contention members, or the female contact includes twelve strips and eight contention members.

11. The electrical connector according to claim 9, wherein the body of the female contact defines a groove extending around the insertion axis and emerging in the housing.

12. The electrical connector according to claim 9, wherein each of the contention members comprises a blade curved in a "C" shape.

13. The electrical connector according to claim 12, wherein the radially outer face of each of the strips defines one or several circumferential slot(s) receiving the contention members.

* * * * *